US006635315B2

(12) United States Patent
Furusawa et al.

(10) Patent No.: US 6,635,315 B2
(45) Date of Patent: Oct. 21, 2003

(54) METHOD FOR IMPROVING SMOOTHNESS OF FILM FORMED FROM THERMOSETTING LIQUID COATING COMPOSITION

(75) Inventors: Satoru Furusawa, Hiratsuka (JP); Masami Yabe, Hiratsuka (JP); Toshihide Fujitani, Hiratsuka (JP)

(73) Assignee: Kansai Paint Co., Ltd., Amagasaki (JP)

( * ) Notice: Subject to any disclaimer, the term of this patent is extended or adjusted under 35 U.S.C. 154(b) by 0 days.

(21) Appl. No.: 10/292,766

(22) Filed: Nov. 13, 2002

(65) Prior Publication Data

US 2003/0152709 A1 Aug. 14, 2003

(30) Foreign Application Priority Data

Nov. 15, 2001 (JP) ..... 2001-350633

(51) Int. Cl.[7] ..... B05D 3/02
(52) U.S. Cl. ..... 427/385.5
(58) Field of Search ..... 427/385.5

(56) References Cited

FOREIGN PATENT DOCUMENTS

JP 51-030836 * 3/1976

OTHER PUBLICATIONS

Hong et al, Korea Polymer Journal, 7(4), pp 213–222, 1999.*

Osterhold, Michael; "Rheological Methods for Characterizing Modern Paint Systems"; Proc. Int. Conf. Org. Coat. Waterbone High Solids Powder Coat. vol. 25$^{th}$, pp 185–201 (1999).

U.S. appln. Ser. No. 10/195,388 filed Jul. 16, 2002 entitled "Method for Improving Crater Resistance of Paint Films"–Copy of Specification attached.

* cited by examiner

*Primary Examiner*—Erma Cameron
(74) *Attorney, Agent, or Firm*—Armstrong, Westerman & Hattori, LLP.

(57) ABSTRACT

The present invention provides a method for improving the smoothness of a film formed from a thermosetting liquid coating composition, comprising making adjustments in the application and heat curing of the coating composition onto a substrate, in such a manner that, at a temperature at which the thermal fluidity of the film reaches a maximum before the start of the curing reaction, the film has a storage modulus G' of about 0.5 to about 20 Pa at a stress of 0.5 Pa and a frequency of 0.1 Hz, a loss modulus G" of about 1.0 to about 20 Pa at a stress of 0.5 Pa and a frequency of 0.1 Hz, and a ratio of the storage modulus G' to the loss modulus G" (G'/G") of about 0.3 to about 1.0.

8 Claims, No Drawings

METHOD FOR IMPROVING SMOOTHNESS OF FILM FORMED FROM THERMOSETTING LIQUID COATING COMPOSITION

BACKGROUND OF THE INVENTION

1. Field of the Invention

The present invention relates to a method for improving the smoothness of a film formed from a thermosetting liquid coating composition.

2. Description of Related Art

The smoothness of a film formed from a thermosetting liquid coating composition greatly influences the finished appearance of the coated article. Therefore, improving the smoothness of films of thermosetting liquid coating compositions is an important issue in the paint industry.

Generally, the heat curing process of a thermosetting liquid coating composition applied to a substrate comprises: the start of volatilization of the solvent from the wet film immediately after application; fluidization of the film by heat; the start of a curing reaction; and substantially complete volatilization of the solvent and curing of the film. In this process, the fluidity of the film caused by heat before the start of the curing reaction is presumed to be a significant factor in determining the smoothness of the resulting film.

Usually, a coating composition that forms a film with low fluidity before the start of the curing reaction results in a cured film with low smoothness.

On the contrary, a coating composition that forms a film with high fluidity before the start of the curing reaction produces a cured film with high smoothness. However, such a coating composition causes the problem of sagging when applied to a substrate having vertical planes. For example, when coating a substrate having horizontal and vertical planes, such as an automobile, a coating composition with high fluidity forms a film that has excellent smoothness on the horizontal planes, but has reduced smoothness on the vertical planes because of sagging of the coating composition.

Therefore, it is necessary to control the thermal fluidity of a film formed from a thermosetting liquid coating composition before the start of the curing reaction, thereby preventing the reduction in film smoothness owing to sagging on vertical planes of the substrate, and achieving satisfactory film smoothness on horizontal planes.

It is usually difficult to control the thermal fluidity of a film before the start of the curing reaction only by selecting and combining the resins, pigments, organic solvents, and other basic constituents of the coating composition. Therefore, a flow modifier, leveling agent, organic solvent, and other additives are added to the coating composition to control the thermal fluidity. Specifically stated, a suitable flow modifier, leveling agent, or organic solvent is found and formulated for each of the coating compositions that differ in their resin or pigment component. Further, the effect of the formulation of such additives is evaluated by testing the smoothness of the heat-cured film.

However, the action of a flow modifier and other additives varies depending on the resin, pigment, organic solvent, or other components of the coating composition. Accordingly, there has been a problem in that the optimum formula needs to be found for each of the coating compositions that differ in their resin component, pigment component, etc., to achieve good film smoothness.

Thus, when a thermosetting liquid coating composition is applied to a substrate, it is desired that the thermal fluidity of the film before the start of the curing reaction in the heat curing process be easily controllable so that good film smoothness is obtained on both the horizontal and vertical planes of the substrate.

BRIEF SUMMARY OF THE INVENTION

An object of the present invention is to provide a method for improving the smoothness of films formed from various thermosetting liquid coating compositions that vary in their resin component, pigment component, etc., not only on the horizontal planes but also on the vertical planes of a substrate.

The present inventors carried out extensive research on the relationship between the viscosity/elasticity of a coating composition and the smoothness of the resulting film. The inventors found that, in the application and heat curing of a coating composition onto a substrate, when adjustments are made in such a manner that, at a specific temperature at which the film is fluidized by heat before the start of the curing reaction, the film has a specific storage modulus, loss modulus, and ratio of these moduli within predetermined ranges, the cured film has improved smoothness on both the horizontal and vertical planes of the substrate. The present invention has been accomplished based on these findings.

The present invention provides the following methods for improving the smoothness of a film formed from a thermosetting liquid coating composition.

1. A method for improving the smoothness of a film formed from a thermosetting liquid coating composition, comprising making adjustments in the application and heat curing of the thermosetting liquid coating composition onto a substrate, in such a manner that, at a temperature at which the thermal fluidity of the film reaches a maximum before the start of the curing reaction, the film has a storage modulus G' of about 0.5 to about 20 Pa at a stress of 0.5 Pa and a frequency of 0.1 Hz, a loss modulus G" of about 1.0 to about 20 Pa at a stress of 0.5 Pa and a frequency of 0.1 Hz, and a storage modulus/loss modulus (G'/G") ratio of about 0.3 to about 1.0.

2. A method according to item 1, wherein the temperature at which the thermal fluidity of the film before the start of the curing reaction reaches a maximum is about 25 to about 90° C.

3. A method according to item 1, wherein the thermosetting liquid coating composition is a clear coating composition, and the adjustments are made in such a manner that the film has the storage modulus G' of about 0.5 to about 2.0 Pa, and the loss modulus G" of about 1.0 to about 2.5 Pa.

4. A method according to item 1, wherein the thermosetting liquid coating composition is a colored coating composition, and the adjustments are made in such a manner that the film has the storage modulus G' of about 1.0 to about 20 Pa and the loss modulus G" of about 2.0 to about 20 Pa.

5. A method according to item 1, wherein the adjustments are made in such a manner that the film has a storage modulus/loss modulus (G'/G") ratio of about 0.4 to about 0.9.

6. A method according to item 1, wherein the adjustments are made by modification of the thermosetting liquid coating composition before application.

7. A method according to item 6, wherein the modification of the thermosetting liquid coating composition before application is carried out by addition of a flow modifier and/or addition of a solvent.

8. A method according to item 7, wherein the flow modifier is at least one member selected from the group consisting of fine silica powders, fine barium sulfate powders, fine particulate organic resins, clay-containing flow modifiers, polyamide-containing flow modifiers, urea-containing flow modifiers, urethane-containing flow modifiers, high acid value acrylic emulsion-containing flow modifiers, polycarboxylic acid salt-containing flow modifiers, and cellulose-containing flow modifiers.

DETAILED DESCRIPTION OF THE INVENTION

There is no limitation on the substrate used in the method of the present invention. Examples of substrates include metal substrates, such as steel sheets or plates (e.g., cold rolled steel plates, galvanized steel plates, zinc alloy plated steel plates, stainless steel plates, tinned steel plates, etc.), aluminum sheets or plates, aluminum alloy sheets or plates, and magnesium alloy sheets or plates; the above-mentioned metal substrates surface-treated with phosphate, chromate, composite oxide, or the like; plastic substrates; inorganic ceramic substrates, such as glass, cement, slate, mortar, concrete, and tile; paper; coated substrates prepared by coating the above-mentioned substrates; and processed articles of these substrates. Examples of zinc alloy plated steel sheets or plates are steel sheets or plates coated with a zinc alloy, such as iron/zinc, nickel/zinc, or aluminium/zinc.

The thermosetting liquid coating composition used in the present invention can be an organic solvent-based coating composition or aqueous coating composition comprising a resin, optionally with a curing agent.

Any known resin for thermosetting coating compositions can be used in the coating composition. Representative examples include acrylic resins, polyester resins, alkyd resins, epoxy resins, polyamide resins, silicon polyester resins, silicon acrylic resins, fluororesins, epoxy resins, modified resins thereof, and the like. These resins can be used either singly or in combination, and may be used in combination with curing agents. Examples of curing agents include amino resins (e.g., melamine resins), epoxy compounds, polyamine compounds, polyisocyanate compounds, blocked polyisocyanate compounds, and the like. It is also possible to use a combination of an epoxy-containing acrylic resin and a carboxyl-containing acrylic resin.

The thermosetting liquid coating composition can be a clear coating composition, or a colored coating composition containing a coloring pigment and/or a luster pigment. If necessary, the composition may contain other pigments, such as extender pigments.

Examples of coloring pigments include inorganic pigments, such as titanium dioxide and iron oxide; organic pigments, such as phthalocyanine blue, quinacridone red, perylene red, and phthalocyanine green; and the like. Examples of luster pigments include aluminium flakes, mica flakes, and the like. Examples of extender pigments include barium sulfate, calcium carbonate, talc, clay, and the like.

When the thermosetting liquid coating composition is an organic solvent-based coating composition, useful organic solvents include, for example, xylene, toluene, ethyl acetate, isobutyl acetate, ethanol, butanol, cyclohexanol, acetone, methyl ethyl ketone, methyl isobutyl ketone, ethylene glycol monobutyl ether, propylene glycol monomethyl ether, and the like. It is usually appropriate that the solids concentration of the organic solvent-based coating composition be about 20 wt. % to about 70 wt. %.

When the coating composition is an aqueous coating composition, water or a mixed solvent of water and an aqueous organic solvent can be used as the solvent. Examples of aqueous organic solvents include ethylene glycol monobutyl ether, propylene glycol monomethyl ether, ethanol, butanol, isopropanol, and the like. It is usually appropriate that the solids concentration of the aqueous coating composition be about 20 wt. % to about 70 wt. %.

In the method of the present invention, the thermosetting liquid coating composition can be applied to a substrate by air spray coating, rotary atomization spray coating, airless spray coating, roll coating, brush coating, curtain coating, dip coating, or like processes. Particularly preferred are spray coating processes, such as air spray coating, rotary atomization spray coating, and airless spray coating. These spray coating processes may be electrostatic spray coating processes.

When the coating composition is applied by spray coating, the viscosity of the composition is preferably adjusted to, for example, about 15 to about 40 seconds (Ford Cup #4/20° C.) using the above-mentioned solvent.

The coating composition is applied to the substrate to a cured film thickness of about 10 to about 60 $\mu$m, preferably about 20 to about 40 $\mu$m.

The method of the present invention improves the smoothness of a film formed from a thermosetting liquid coating composition, by making adjustments in the application and heat curing of the coating composition onto a substrate, in such a manner that, at a temperature at which the thermal fluidity of the film before the start of the curing reaction reaches a maximum, the film has a storage modulus G' of about 0.5 to about 20 Pa at a stress of 0.5 Pa and a frequency of 0.1 Hz, a loss modulus G" of about 1.0 to about 20 Pa at a stress of 0.5 Pa and a frequency of 0.1 Hz, and a storage modulus/loss modulus (G'/G") ratio of about 0.3 to about 1.0.

The heat curing process of a thermosetting liquid coating composition applied to a substrate generally comprises: the start of volatilization of the solvent from the wet film immediately after application; fluidization of the film by heat; the start of a curing reaction; and substantially complete volatilization of the solvent and curing of the film. In the method of the present invention, adjustments are made so that, in the above process, the uncured film before the start of the curing reaction has a storage modulus G', loss modulus G", and ratio of these moduli (G'/G") within specific ranges, to thereby remarkably improve the smoothness of the cured film.

The thermosetting liquid coating composition applied to the substrate can be usually heat-cured using a known dryer, such as a box type hot air dryer or a conveyor type hot air dryer. The conditions for heat curing vary depending on the components of the coating composition, but it is usually suitable to heat the composition at about 100 to about 180° C., preferably about 120 to about 160° C., for about 5 to about 60 minutes, preferably about 15 to about 40 minutes.

Under the above heat curing conditions, the solvent is volatilized and the thermal fluidization before the start of the heat curing occurs while the temperature rises to the curing temperature, and after the curing temperature is reached, the curing reaction starts, and the film is cured.

The temperature at which the thermal fluidity of the film before the start of the curing reaction reaches a maximum varies depending on the type of coating composition, but is usually about 25 to about 90° C. This temperature is preferably about 60 to about 90° C. when the coating composition is a clear coating composition, and is preferably about 25 to about 80° C. when the coating composition is a colored coating composition.

The temperature at which the thermal fluidity reaches a maximum can be examined, for example, in the following manner. A coated plate equipped with a temperature sensor is placed in a dryer or the like for heat curing. Before the curing reaction of the film starts, a portion of the uncured film is quickly scraped with a scraper or the like at fixed increments in the temperature of the film, and placed in an airtight container. Then, the viscosity of each scraped portion is measured at the temperature at the time of scraping. Further, when measuring the viscosity, the G' and G" of the film at a temperature at which the thermal fluidity of the uncured film reaches a maximum can be measured at the same time.

The viscosity, G', and G" can be measured using a cone and plate viscometer, which may be, for example, a viscoelasticity measuring device "RheoStress RS150" (tradename) manufactured by HAAKE.

In the method of the present invention, it is necessary that, in heat curing of a coating composition applied to a substrate, at a temperature at which the thermal fluidity of the uncured film before the start of the heat curing reaction reaches a maximum, the film have a G' of about 0.5 to about 20 Pa at a stress of 0.5 Pa and a frequency of 0.1 Hz, and a G" of about 1.0 to about 20 Pa at a stress of 0.5 Pa and a frequency of 0.1 Hz. When the coating composition is a clear coating composition, it is usually preferable that the G' be in a range of about 0.5 to about 2.0 Pa, and the G" be in a range of about 1.0 to about 2.5 Pa. When the coating composition is a colored coating composition, it is usually preferable that the G' be in a range of about 1.0 to about 20 Pa, and the G" be in a range of about 2.0 to about 20 Pa.

Further, according to the method of the present invention, adjustments are made in the application and heat curing of the coating composition onto a substrate, so that, at a temperature at which the thermal fluidity of the uncured film before the start of the heat curing reaction reaches a maximum, the film has a G'/G" ratio of about 0.3 to about 1.0, preferably about 0.4 to about 0.9. When the G'/G" ratio is less than 0.3, the film is liable to sag and lose its smoothness on vertical planes of the substrate. On the other hand, when the ratio is over 1.0, the film lacks fluidity and becomes rough, leading to reduced smoothness.

The G', G", and G'/G" are measured at a temperature at which the thermal fluidity of the uncured film reaches a maximum, or at a temperature close to that temperature. The G', G", and G'/G" in the above-specified ranges indicate the improvement of film smoothness. The "temperature close to that temperature" means a temperature within a range of usually plus or minus about 8° C., preferably plus or minus about 5° C., from the temperature at which the thermal fluidity of the uncured film reaches a maximum.

The storage modulus G', loss modulus G", and G'/G" ratio of the uncured film after application to a substrate can be adjusted to the specific ranges according to the present invention by, for example, modification of the thermosetting liquid coating composition before application, modification of the coating process, modification of the coating conditions, modification of the curing conditions, or other means. Among these means, modification of the thermosetting liquid coating composition before application is the most reliable and desirable.

Examples of means for modification of the thermosetting liquid coating composition are addition of a flow modifier, addition of a solvent, adjustment of the molecular weight of the resin, adjustment of the polarity of the resin, adjustment of the pigment concentration, and the like. These means can be employed either singly or in combination. Modification by addition of a flow modifier or addition of a solvent is easy and effective, and thus desirable.

Examples of flow modifiers include, but are not limited to, fine silica powders; fine barium sulfate powders; fine particulate organic resins; flow modifiers containing clay, such as bentonite; polyamide-containing flow modifiers; urea-containing flow modifiers; urethane-containing flow modifiers, such as polyether-modified urethane compounds; high acid value acrylic emulsion-containing flow modifiers; polycarboxylic acid salt-containing flow modifiers; cellulose-containing flow modifiers; and the like.

It is desirable that the fine particulate organic resins have an average particle diameter of about 1 nm to about 1 $\mu$m, preferably about 50 to about 500 nm. The kind of resin can be, for example, polyethylene, polypropylene, polytetrafluoroethylene, a silicon rubber, an acrylic resin, a urethane resin, a phenol resin, or the like. A representative example of a fine particulate organic resin is the internally crosslinked fine particulate acrylic resin disclosed in Japanese Unexamined Patent Publication No. 1991-62860. The internally crosslinked fine particulate acrylic resin is obtained by carrying out emulsion polymerization of polymerizable unsaturated monomer components including multifunctional monomers having two or more polymerizable unsaturated groups, such as divinylbenzene and 1,6-hexanediol dimethacrylate, in the presence of a reactive emulsifier having allyl or other polymerizable unsaturated groups, using a water-soluble polymerization initiator, such as a water-soluble azo amide compound.

The addition of such a flow modifier to the coating composition can increase the storage modulus/loss modulus (G'/G") ratio of the film at a temperature at which the thermal fluidity of the film before the start of the curing reaction reaches a maximum, in the heat curing process of a coating composition applied to a substrate.

Solvents useful for modification of the coating composition include water and known organic solvents conventionally used in coating compositions. For example, the addition of a solvent with a higher volatilization rate, i.e., compositional modification of the solvent component of the coating composition to achieve a higher volatilization rate, can increase the G'/G" ratio. On the contrary, the addition of a solvent with a lower volatilization rate, i.e., compositional modification of the solvent component of the coating composition to achieve a lower volatilization rate, can decrease the G'/G" ratio.

The coating composition can be modified by adjustment of the molecular weight of the resin component, to thereby adjust the G'/G" ratio. Usually, the G'/G" ratio can be increased by raising the molecular weight of the resin component. On the other hand, the G'/G" ratio can be decreased by lowering the molecular weight of the resin component. Resins useful for adjusting the molecular weight include, for example, acrylic resins, polyester resins, alkyd resins, epoxy resins, polyamide resins, silicon polyester resins, silicon acrylic resins, fluororesins, and modified products of these resins; amino resins (e.g., melamine resins), epoxy compounds, polyamine compounds, polyisocyanate compounds, and blocked polyisocyanate compounds used as curing agents; and the like.

The coating composition can be modified also by adjustment of the pigment concentration in the composition in the following manner. A pigment paste having the same pigment makeup as the coating composition is added to raise the pigment concentration relative to the resin content, or a pigment-free clear coating composition is added to lower the pigment concentration relative to the resin content, to thereby adjust the G'/G" ratio. Raising the pigment concentration increases the G'/G" ratio, and lowering the pigment concentration decreases the G'/G" ratio.

The G'/G" ratio of the film after application to a substrate and before the start of the curing reaction can be adjusted to the specific range of the present invention by modifying the coating process. For example, spray coating may be employed in place of other coating processes. In spray coating, a considerable amount of solvent evaporates before atomized particles of the coating composition adhere to the surface of a substrate. Therefore, when the same coating composition is used, spray coating, as compared to other coating processes, can increase the G'/G" ratio of the wet film immediately after application. The increase in the G'/G" ratio of the wet film leads to an increased G'/G" ratio of the film before the start of the curing reaction.

The coating conditions may be modified to adjust the G'/G" ratio to the specific range of the present invention. For example, an increased air pressure is used in air spray coating so that a more finely atomized coating composition can be sprayed, which accelerates the volatilization of the solvent during the coating process. Thus, the wet film immediately after application is provided with an increased G'/G" ratio. The increase in the G'/G" ratio of the wet film leads to an increased G'/G" ratio of the film before the start of the curing reaction.

The G'/G" ratio can be adjusted to the specific range of the present invention by modifying the curing conditions. For example, an increased amount of hot air is used for curing to accelerate volatilization of the solvent. Thus, the G'/G" ratio of the film in the heat curing process can be increased.

According to the method of the present invention, a coated article can be obtained which has good film smoothness on both the vertical and horizontal planes of the substrate, by adjusting, to the specific range, the storage modulus G'/loss modulus G" ratio of the film after application to a substrate and before the start of the curing reaction.

EXAMPLES

The following Production Examples and Examples illustrate the present invention in further detail. In these examples, parts and percentages are all by weight.

Production Example 1

Production of Alkyd Resin for Clear Coating Composition

The reaction vessel of a resin production apparatus equipped with a heater, stirrer, reflux device, water separator, fractionating column, and thermometer was charged with phthalic anhydride (148 parts), trimethylolpropane (134 parts), and coconut oil fatty acid (105 parts), followed by heating.

After the components in the reaction vessel were melted and rendered stirrable, stirring was started, and the temperature in the reaction vessel was raised to 230° C. in such a manner that the temperature rise from 160° C. to 230° C. took place at a uniform rate over 3 hours. The condensed water was distilled off from the system through the fractionating column. When the temperature reached 230° C., the same temperature was maintained while continuing stirring for 2 hours. Thereafter, xylene was added to the reaction vessel to change the type of reaction to solvent condensation, and the reaction was continued. When the acid value reached 7 mg KOH/g, the reaction was terminated, and the reaction mixture was cooled. Then, xylene (145 parts) was added, thereby giving an alkyd resin solution with a solids content of 60% and a viscosity of WX (25° C. Gardner viscosity).

The obtained alkyd resin had a weight average molecular weight of 15,000, an acid value of 7 mg KOH/g, a hydroxyl value of 85 mg KOH/g, and an oil length of 31%.

Production Example 2

Production of Alkyd Resin for Pigment Dispersion

A four-necked flask equipped with a stirrer and fractionating column was charged with coconut oil fatty acid (276 parts), trimethylpropane (286 parts), neopentyl glycol (55 parts), and phthalic acid (383 parts), followed by stirring with heating, to obtain an alkyd resin for pigment dispersion having an acid value of about 5 mg KOH/g, a hydroxyl value of about 57.3 mg KOH/g, and a weight average molecular weight of 30,000.

Production Example 3

Production of Alkyd Resin Clear Coating Composition

The alkyd resin for clear coating compositions obtained in Production Example 1 (70 parts on a solids basis), a methylated melamine resin (tradename "Cymel 202", manufactured by Mitsui-Cytec, Ltd.) (30 parts on a solids basis), xylene (56 parts), n-butanol (35 parts), methyl ethyl ketone (9 parts), and an acrylic resin-containing surface modifier (tradename "BYK352", manufactured by BYK-Chemie) (0.5 parts) were mixed together, to obtain an alkyd resin clear coating composition with a solids content of 50%.

Production Example 4

Production of Fine Particulate Organic Resin

A flask equipped with a stirrer, thermometer, condenser tube, and heating mantle was charged with deionized water (3536.5 parts) and sulfosuccinic acid-based, allyl-containing anionic reactive emulsifier (tradename "Eleminol JS-2", manufactured by Sanyo Chemical Industries, Ltd., an aqueous solution with a solids content of 39%) (51 parts (20 parts on a solids basis)), followed by heating to 90° C. with stirring. To the resulting mixture was added 20% (102.5 parts) of an aqueous solution of a polymerization initiator obtained by dissolving 2,2'-azobis[2-methyl-N-(2-hydroxyethyl)-propionamide] (12.5 parts) in deionized water (500 parts). After 15 minutes, 50 parts of a monomer mixture of styrene/n-butyl acrylate/1,6-hexanediol diacrylate=47/47/6 (weight ratio) was added. After a further 30 minutes of stirring, the same monomer mixture (950 parts) and the remainder of the aqueous polymerization initiator solution (410 parts) began to be added dropwise. The addition of the monomer mixture and the addition of the aqueous polymerization initiator solution were carried out over 3 hours and 3.5 hours, respectively. During the addition, the polymerization temperature was maintained at 90° C. After completion of the addition of the aqueous polymerization initiator solution, the reaction mixture was heated and maintained at 90° C. for 30 minutes, cooled to room temperature, and filtered through silk. Thus, an aqueous dispersion of an aqueous gelled fine particulate resin with a solids content of 20% was obtained.

The obtained aqueous dispersion was placed in a stainless steel vat, dried in an electric hot air dryer, and taken out as a solid resin. The solid resin was added to and dispersed in a mixed solvent of xylene/n-butyl alcohol=50/50 (weight ratio) that had been heated to 60° C., to prepare a gelled fine particulate resin dispersion with a solids concentration of 20%. The fine particulate resin had an average particle diameter of about 80 nm.

Production Example 5

Production of Fine Barium Sulfate Powder Paste

A mixture of a fine barium sulfate powder (tradename "BF-20", manufactured by Sakai Chemical Industry, Co., Ltd, having an average particle diameter of about 20 nm) (25 parts), the alkyd resin for pigment dispersion obtained in Production Example 2 (25 parts on a solids basis), and xylene (50 parts) was dispersed in a paint shaker for 2 hours using glass beads with a diameter of 1 mm as a dispersion medium, thereby giving a fine barium sulfate powder paste with a solids content of 50%.

Example 1

To 200 parts of the 50% alkyd resin clear coating composition obtained in Production Example 3 was added the fine particulate organic resin dispersion obtained in Production Example 4 as a flow modifier in amounts of 0, 2, 4, and 6 parts (as solids in the particulate resin), to prepare four mixtures. The mixtures were diluted with xylene to a viscosity of 23 seconds (Ford cup #4/20° C.), thereby giving four clear coating compositions.

Each of the obtained coating compositions was applied to a tin plate (40 cm×50 cm) by air spray to a cured film thickness of 40 μm, and set for 3 minutes. The coated plate was equipped with a temperature sensor and placed in a box type hot air dryer at 140° C. At about 10° C. increments in the temperature of the coated plate, a portion of the uncured film before the start of the curing reaction in the heat curing process was quickly scraped with a scraper and placed in an airtight container. The viscosity and the storage modulus G' and loss modulus G" at a stress of 0.5 Pa and a frequency of 0.1 Hz of the scraped portions of the film were measured at the temperatures at the time of scraping, using a viscoelasticity measuring device "RheoStress RS150" manufactured by HAAKE. The viscosities of the portions of the film before the start of the curing reaction sampled at 10° C. increments were plotted against the temperatures at the time of sampling, to find the temperature at which the thermal fluidity reaches a maximum, and the storage modulus G', loss modulus G", and G'/G" ratio at that temperature. The temperature at which the thermal fluidity reaches a maximum was 70° C.

Separately, each of the coating compositions was applied to two tin plates (40 cm×50 cm) by air spray in the same manner as above, and set for 3 minutes. Then, the coated plates were placed in a box type hot air dryer at 140° C., one in a horizontal position and the other in a vertical position. After heat curing at 140° C. for 30 minutes, the smoothness of the films on the coated plates placed in the horizontal and vertical positions was determined using "WaveScan" (tradename) manufactured by BYK Gardner.

WaveScan measures the Short Wave value and Long Wave value. The Short Wave value is an index of the amplitude of surface roughness with a wavelength of about 100 μm or more and less than about 600 μm. The Long Wave value is an index of the amplitude of surface roughness with a wavelength of about 600 to about 1,000 μm. The smaller the WaveScan values are, the higher the film smoothness is.

From the measured WaveScan values, the film smoothness was evaluated according to the following criteria. A: Good smoothness on both vertical and horizontal planes; B: Inferior smoothness on at least one of the vertical and horizontal planes; and C: Markedly inferior smoothness on at least one of the vertical and horizontal planes. In the evaluation criteria, good smoothness means WaveScan values less than 15; inferior smoothness means WaveScan values of 15 or more and less than 30; and markedly inferior smoothness means WaveScan values of 30 or more.

Table 1 shows the G', G", G'/G", WaveScan values, and film smoothness evaluated from the WaveScan values.

TABLE 1

| Amount of fine particulate organic resin | 0 part | 2 parts | 4 parts | 6 parts |
|---|---|---|---|---|
| G'/G" | 0.09 | 0.49 | 1.15 | 1.80 |
| G' | 0.16 | 0.94 | 2.87 | 5.60 |
| G" | 1.81 | 1.92 | 2.49 | 3.11 |
| Short Wave value on vertical plane | 26.2 | 11.0 | 25.4 | 39.1 |
| Long Wave value on vertical plane | 19.5 | 7.2 | 11.7 | 29.9 |
| Short Wave value on horizontal plane | 9.3 | 8.4 | 20.1 | 34.8 |
| Long Wave value on horizontal plane | 8.0 | 6.9 | 21.5 | 36.1 |
| Smoothness | B | A | B | C |

As is apparent from Table 1, the addition of 2 parts (on a solids basis) of the fine particulate organic resin to 200 parts of the alkyd resin clear solution achieved a G'/G" ratio of 0.49 and the highest degree of film smoothness on both the vertical and horizontal planes.

Example 2

The 50% alkyd resin clear coating composition obtained in Production Example 3 (200 parts) was diluted to a viscosity of 23 seconds (Ford cup #4/20° C.), with the following three diluent solvents: (1) xylene alone, (2) mixed solvent I consisting of 80 parts of xylene and 20 parts of ethyl acetate, and (3) mixed solvent II consisting of 50 parts of xylene and 50 parts of ethyl acetate, to prepare three coating compositions. The coating compositions were tested for the G' and G" of the uncured film in the heat curing process and film smoothness, in the same manner as in Example 1. Table 2 shows the results.

TABLE 2

| Diluent solvent | Xylene | Mixed solvent I | Mixed solvent II |
|---|---|---|---|
| G'/G" | 0.09 | 0.79 | 1.95 |
| G' | 0.16 | 1.69 | 5.25 |
| G" | 1.81 | 2.15 | 2.69 |
| Short Wave value on vertical plane | 26.2 | 12.9 | 38.5 |
| Long Wave value on vertical plane | 19.5 | 10.2 | 34.9 |
| Short Wave value on horizontal plane | 9.3 | 9.1 | 30.1 |
| Long Wave value on | 8.0 | 8.9 | 34.2 |

TABLE 2-continued

| Diluent solvent | Xylene | Mixed solvent I | Mixed solvent II |
|---|---|---|---|
| horizontal plane Smoothness | B | A | C |

Table 2 reveals that the use of mixed solvent I (80 parts of xylene and 20 parts of ethyl acetate) as a diluent solvent accomplished a G'/G" ratio of 0.79 and the highest degree of film smoothness on both the vertical and horizontal planes.

Example 3

To the 50% alkyd resin clear coating composition obtained in Production Example 3 (200 parts) was added the fine barium sulfate powder paste with a solids content of 50% obtained in Production Example 5 as a flow modifier in amounts of 0, 12, 24, and 48 parts to prepare four mixtures. The mixtures were diluted with xylene to a viscosity of 23 seconds (Ford cup #4/20° C.). The resulting four coating compositions were tested for the G' and G" of the uncured film in the heat curing process and film smoothness, in the same manner as in Example 1. Table 3 shows the results.

TABLE 3

| Amount of 50% fine barium sulfate powder paste | 0 part | 12 parts | 24 parts | 48 parts |
|---|---|---|---|---|
| G'/G" | 0.09 | 0.32 | 0.66 | 1.32 |
| G' | 0.16 | 0.61 | 1.33 | 3.38 |
| G" | 1.81 | 1.92 | 2.01 | 2.56 |
| Short Wave value on vertical plane | 26.2 | 14.2 | 11.4 | 19.6 |
| Long Wave value on vertical plane | 19.5 | 13.2 | 8.6 | 16.1 |
| Short Wave value on horizontal plane | 9.3 | 10.1 | 9.8 | 17.4 |
| Long Wave value on horizontal plane | 8.0 | 7.5 | 7.8 | 15.7 |
| Smoothness | B | A | A | B |

Table 3 reveals that the addition of 12 parts of the fine barium sulfate powder paste with a solids content of 50% achieved a G'/G" ratio of 0.32, and that the addition of 24 parts of the paste attained a G'/G" ratio of 0.66. Table 3 also shows that the addition of 12 or 24 parts of the paste achieved the highest degree of film smoothness on both the vertical and horizontal planes.

In the method of the present invention, adjustments are made so that, in the heat curing process of a coating composition applied to a substrate, the uncured film before the start of the curing reaction has a storage modulus, loss modulus, and storage modulus/loss modulus ratio within predetermined ranges at a specific stress. As the result, the method of the present invention remarkably improves the film smoothness on both vertical and horizontal planes.

What is claimed is:

1. A method for improving the smoothness of a film formed from a thermosetting liquid coating composition, comprising making adjustments in the application and heat curing of the thermosetting liquid coating composition onto a substrate, in such a manner that, at a temperature at which the thermal fluidity of the film reaches a maximum before the start of the curing reaction, the film has a storage modulus G' of about 0.5 to about 20 Pa at a stress of 0.5 Pa and a frequency of 0.1 Hz, a loss modulus G" of about 1.0 to about 20 Pa at a stress of 0.5 Pa and a frequency of 0.1 Hz, and a storage modulus/loss modulus (G'/G") ratio of about 0.3 to about 1.0.

2. A method according to claim 1, wherein the temperature at which the thermal fluidity of the film before the start of the curing reaction reaches a maximum is about 25 to about 90° C.

3. A method according to claim 1, wherein the thermosetting liquid coating composition is a clear coating composition, and the adjustments are made in such a manner that the film has the storage modulus G' of about 0.5 to about 2.0 Pa, and the loss modulus G" of about 1.0 to about 2.5 Pa.

4. A method according to claim 1, wherein the thermosetting liquid coating composition is a colored coating composition, and the adjustments are made in such a manner that the film has the storage modulus G' of about 1.0 to about 20 Pa and the loss modulus G" of about 2.0 to about 20 Pa.

5. A method according to claim 1, wherein the adjustments are made in such a manner that the film has a storage modulus/loss modulus (G'/G") ratio of about 0.4 to about 0.9.

6. A method according to claim 1, wherein the adjustments are made by modification of the thermosetting liquid coating composition before application.

7. A method according to claim 6, wherein the modification of the thermosetting liquid coating composition before application is carried out by addition of a flow modifier and/or addition of a solvent.

8. A method according to claim 7, wherein the flow modifier is at least one member selected from the group consisting of fine silica powders, fine barium sulfate powders, fine particulate organic resins, clay-containing flow modifiers, polyamide-containing flow modifiers, urea-containing flow modifiers, urethane-containing flow modifiers, high acid value acrylic emulsion-containing flow modifiers, polycarboxylic acid salt-containing flow modifiers, and cellulose-containing flow modifiers.

* * * * *